US006732955B1

(12) United States Patent
Ritsche et al.

(10) Patent No.: US 6,732,955 B1
(45) Date of Patent: May 11, 2004

(54) DISPENSER FOR MEDIA AND METHOD FOR PRODUCING A DISPENSER

(75) Inventors: Stefan Ritsche, Radolfzell (DE); Lothar Graf, Gottmadingen (DE)

(73) Assignee: Ing. Erich Pfeiffer GmbH (DE)

( * ) Notice: Subject to any disclaimer, the term of this patent is extended or adjusted under 35 U.S.C. 154(b) by 0 days.

(21) Appl. No.: 09/743,843

(22) PCT Filed: Jul. 8, 1999

(86) PCT No.: PCT/EP99/04802

§ 371 (c)(1),
(2), (4) Date: Mar. 2, 2001

(87) PCT Pub. No.: WO00/03812

PCT Pub. Date: Jan. 27, 2000

(51) Int. Cl.[7] ..... B05B 9/043

(52) U.S. Cl. ..... 239/333; 239/271; 239/272; 239/327; 239/337; 239/309

(58) Field of Search ..... 239/327, 271, 239/272, 333, 337, 309; 222/333

(56) References Cited

U.S. PATENT DOCUMENTS

| | | | | |
|---|---|---|---|---|
| 3,013,308 A | | 12/1961 | Armour | |
| 3,240,434 A | | 3/1966 | Bradley | |
| 3,685,933 A | | 8/1972 | Schneider | |
| 4,253,609 A | * | 3/1981 | Laauwe | 239/327 |
| 4,280,976 A | | 7/1981 | Von Holdt | |
| 5,509,578 A | | 4/1996 | Livingstone | |
| 5,511,698 A | | 4/1996 | Solignac | |
| 5,615,835 A | | 4/1997 | Nelson | |
| 5,743,468 A | | 4/1998 | Laidler | |

FOREIGN PATENT DOCUMENTS

| | | |
|---|---|---|
| DE | 78 06 846 | 8/1978 |
| DE | 36 31 341 | 4/1987 |
| DE | 40 21 263 | 1/1992 |
| DE | 41 26 041 | 2/1992 |
| DE | 92 16 359 | 5/1993 |
| DE | 43 10 575 | 9/1994 |
| DE | 44 12 041 | 10/1995 |
| DE | 44 17 486 | 11/1995 |
| DE | 195 25 734 | 1/1997 |
| DE | 197 00 437 | 7/1997 |
| DE | 196 05 153 | 8/1997 |
| DE | 196 07 691 | 9/1997 |
| DE | 196 37 101 | 3/1998 |
| EP | 0 201 655 | 11/1986 |
| EP | 0 477 563 | 4/1992 |
| FR | 2 698 854 | 6/1994 |
| WO | WO94/13407 | 6/1994 |
| WO | WO98/05433 | 2/1998 |

* cited by examiner

*Primary Examiner*—Robin O. Evans
(74) *Attorney, Agent, or Firm*—Akerman Senterfitt

(57) ABSTRACT

A piston plunger (1) is injection molded from two longitudinal sections (2, 3) in parallel axial position. The shorter component (3) is then pivoted around a hinge joint (4) into position having the same axis as the other component (2) and tightly connected to the latter using locking means (20). The shorter component (3) then forms a nozzle core (67) and the longer component (2) forms a piercing tip (68) for opening a piston membrane (75).

19 Claims, 5 Drawing Sheets

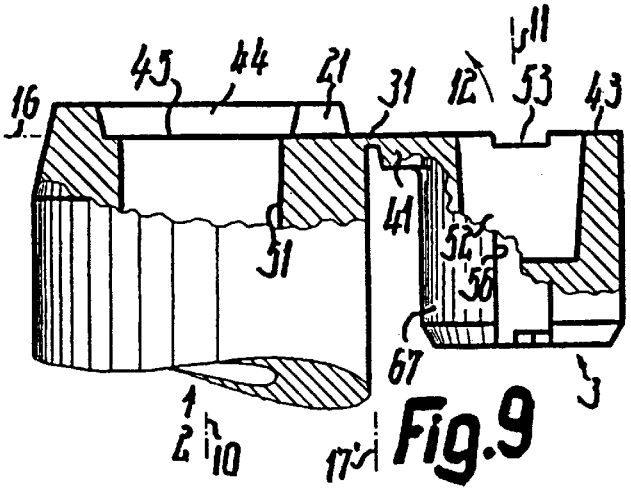
Fig.9
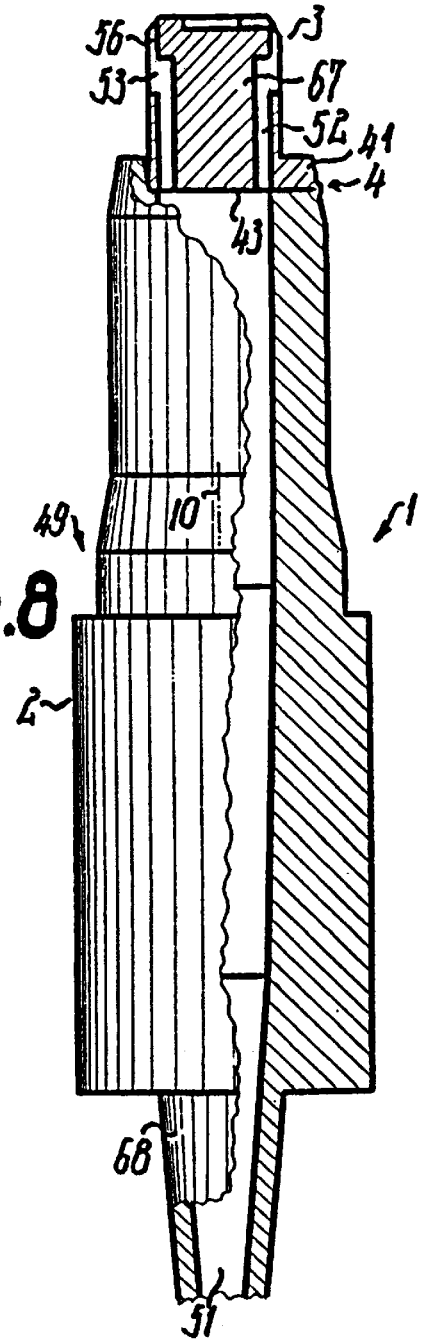
Fig.8
Fig.10
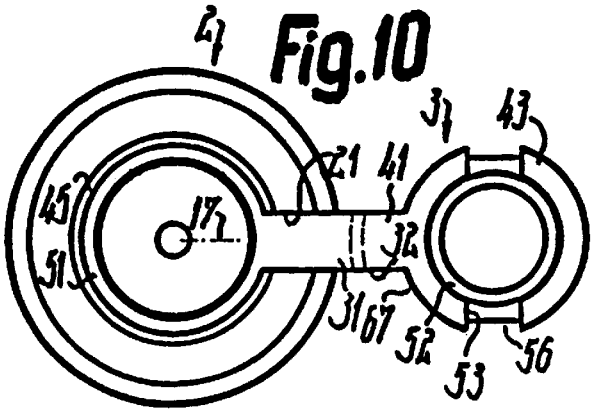

DISPENSER FOR MEDIA AND METHOD FOR PRODUCING A DISPENSER

TECHNICAL FIELD AND BACKGROUND OF THE INVENTION

The invention relates to a dispenser or an assembly suitable as a dispenser, serving as a receptacle, reservoir and/or discharger for media which may be liquid, pasty, powdery and/or gaseous. All components of the dispenser or assembly may be made of plastics or as compression or injection molded components. For discharge the dispenser can be freely held and simultaneously actuated single-handedly. Its length thus amounts to max. 10 cm or 7 cm, its largest width not more than 8 cm or 5 cm. The dispenser is suitable for dispensing single droplets of the medium, a jet or atomized particle or droplet aerosol thereof. Furthermore, the dispenser may be configured for discharging but a single dose of the medium or for a single stroke with no return stroke or for repeated discharges each with a spring-actuated return stroke inbetween.

Experience has shown it to be expedient to compose complicated assemblies of components molded separately which during molding are located with or without a direct joint spaced away from each other or in a position other than that required in the operating condition. Reference is made to the German laid-open document 196 05 153 as well as to the pending German patent 198 13 078.3 in including the features and effects described therein in the present invention.

SUMMARY OF THE INVENTION

The invention is based on the object of providing a dispenser or a method of producing an assembly for a dispenser or the like which avoids the disadvantages of known configurations. It is more particularly the object to provide assemblies which have an increasing or decreasing inner or outer cross-section in the opposing direction. The dispenser is intended for facilitated production and safe operation.

In accordance with the invention two or more components are produced at the same time or with the same flow of plasticated material, immediately demolded once solidified or released in some other way at their jointing zones and then directly positioned relative to each other so that they can then be combined into an assembly. For the components the same material or differing materials may be employed. The components pass through the same temperature curves at the same time up to solidification and may have the same or differing volume of material. Expediently the components are produced in the same mold or so that they adjoin one or more common parts of the mold each integrally. This applies more particularly to the jointing surface areas of the components moldable juxtaposed in common by a movable part of the mold. After the components have solidified and subsequent retraction thereof or of another part of the mold these jointing zones are located exposed. The components can then be moved relative to each other until joined together and demolded completely where necessary. It is good practice when the components are located in production axially parallel or directly juxtaposed almost in contact with each other. Once the one component has been joined to the other it forms an elongation of the other component in the direction of its greatest extent. After being joined, forming the operating condition of the assembly for operation of the dispenser, the two components merge into a length which is smaller than the length of the one or other component. The components may, however, also be face joined without any mutual longitudinal engagement and locked in place mutually by a further component. Thus mutual locking of the components may be with zero clearance or positive, namely by being radially centered or by a captive lock.

Although the configuration in accordance with the invention is suitable for the outer or base bodies of dispensers it is particularly expedient for core bodies. One such core body is located totally concealed in the interior of the dispenser of the corresponding base body, e.g. within a discharge nozzle. This base body may also form the third component for the cited locational lock. Advantageously one or both components of the assembly forms longitudinally a middle section of largest outer width, w adjoining at each end thereof an end section of comparitively reduced outer width. Each of the end sections is formed by another component. An end section may be a hollow needle having a smallest diameter at the tip of the needle of less than one millimeter and a length of less than 10 or 8 mm. The other end section may be a dished, fluted or outer face-recessed body having a radially protruding collar forming the shorter longitudinal part of the middle section.

The two components are advantageously joined to each other via a single connecting member or link directly joining each of the components by a link section. The link sections are then mutually movable and adjoined by a connecting location which may remain stationary in mutual movement of the components such as in movement of the corresponding link section relative to the corresponding component. The connecting location is expediently a hinging zone having a sole hinging axis and/or a designed frangible location at which the link sections are parted in mutual movement of the components and prior to attaining the operating position in forming opposing fractured surface areas. The mold cavity for the link may form the one or sole flow channel via which the plasticated material flows from the mold cavity for the one component, more particularly the larger volume component, into the mold cavity for the other component. The smallest cross-section of this channel and thus of the link may be less than 5, 2 or one tenth of a $mm^2$.

In production the jointing surface areas of the two components later to directly adjoin in the operating position are expediently located in the same plane. Beyond one of these jointing surface areas a locking member or the like may protrude. In production these jointing surface areas may point in the same direction or in opposite directions. Up to each jointing surface area the link may also extend which may comprise a surface directly translating into the jointing surface areas in the same plane or frangible or parting surface areas in this plane after parting. The components may also be translated by a radial or linear movement into their operating position, the one component forming a sliding guide for the other component flanked only at the bottom and sides which, however, does not attain the guide until after a first portion of the shifting travel or after the link has been parted. In addition, the components may be produced separately and then assembled in accordance with the invention.

Irrespective of the configuration as described, the dispenser is configured more particularly as a receptacle and reservoir for biological active substances over several weeks, months or even years. These may be physiological active substances containing hormones and/or cleavage products such as peptides containing protein. Such biological information transmitters which may contain amino acids and other similar active substances may be highly sensitive to moisture, this being the reason why they are held in the dispenser in a pressure-tight chamber which is not opened until immediately prior to delivery from the dispenser, e.g. by a closure being ruptured by means of the cited assembly.

These and further features of the invention also read from the description and the drawings, each of the individual features being achieved by themselves or severally in the form of sub-combinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DETAILLED DESCRIPTION

Figure 2:
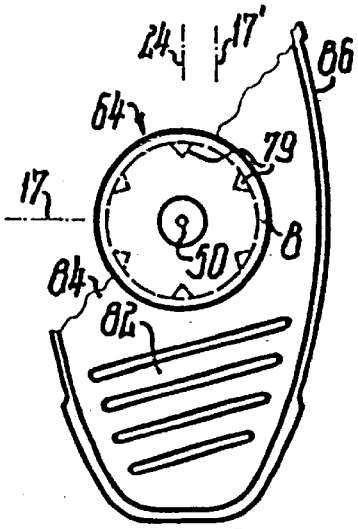
FIG. 2 is a plan view of the dispenser as shown in FIG. 1, illustrated turned through 90°.
Figure 1:
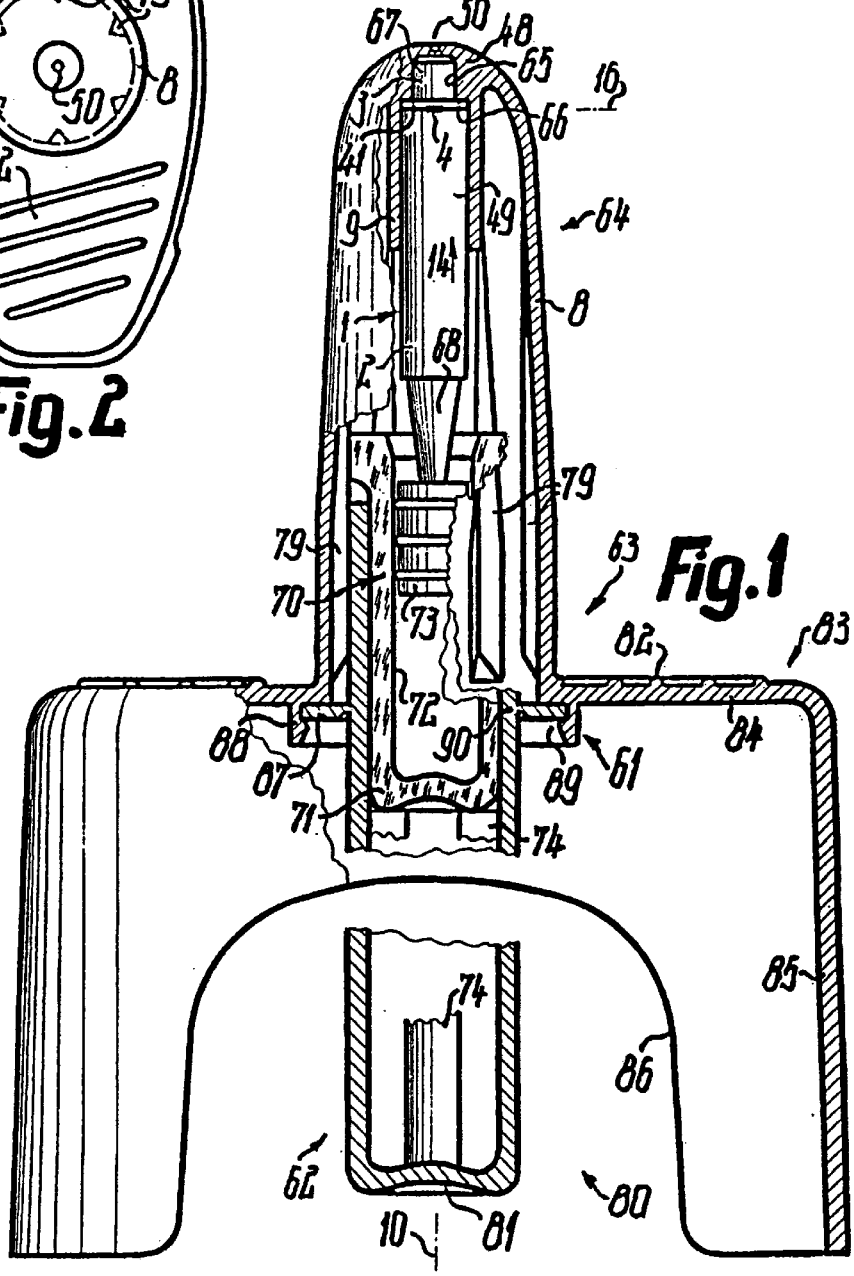
FIG. 1 is a partly sectioned view of the dispenser in accordance with the invention.
Figure 4:
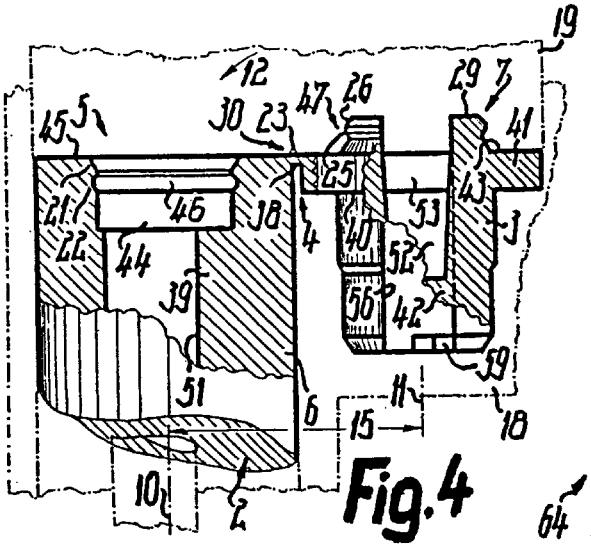
FIG. 4 is a detail taken from FIG. 3 on a further magnified scale.
Figure 5:
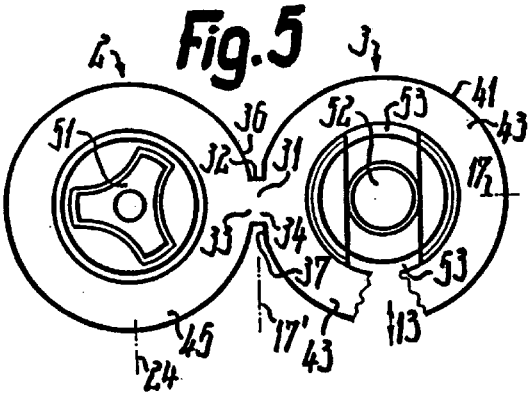
FIG. 5 is a plan view of that shown in FIG. 4.
Figure 3:
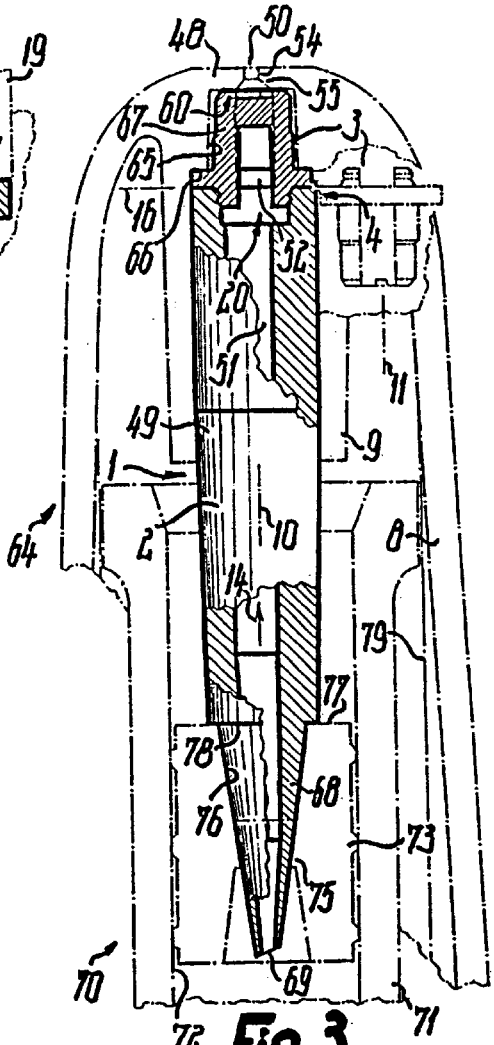
FIG. 3 is a detail taken from FIG. 1 on a magnified scale.
Figure 7:
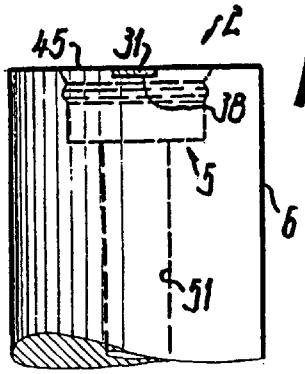
FIG. 7 is a longitudinal section through FIG. 4, FIGS. 8–10 illustrate further example embodiments as shown in FIGS. 3 to 5, FIGS. 11–13 illustrate a further embodiment of that as shown in FIGS. 3 to 5.
Figure 6:
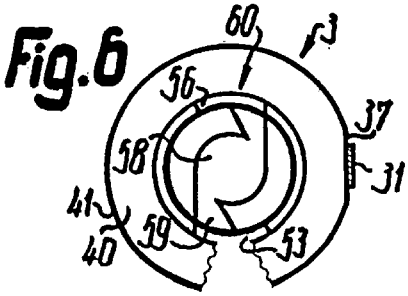
FIG. 6 is a plan view of that shown in FIG. 3 on the same scale as in FIG. 4.
Figure 14:
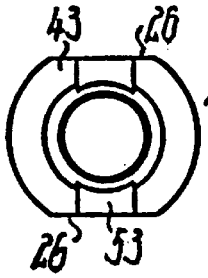
FIG. 14 is a view from underneath of the smaller component as shown in FIG. 12.

Referring now to FIGS. 1 to 3 there is illustrated the dispenser including the assembly 1 comprising at one end as an inner body, a freely protruding piston slaving element, a snugly enclosed rod section, a plunger, a tubular passage, a plunger body, a spike, a coupling member for a medium expeller, a nozzle core, a definition of a swirl chamber, a definition of a longitudinal passage, a definition of a transverse passage, a stiffening member, a filler, a stroke stop and the like. The dispenser is composed of two components 2, 3 integrally joined in a common axis. Component 2 is at least four or six times longer than component 3 and axially symmetrical over its full length. In the first position and in the mold the components 2, 3 are located juxtaposed axially parallel as shown in FIGS. 4 and 5. In the operating position as shown in FIGS. 1 and 3, component 3 is a downstream elongation of component 2 to which it is connected telescopically movable or fixed. In both positions components 1, 2 are interconnected full length solely by a single, flexible connection 4 with no surface area joint.

For guiding. centering and movingly or fixedly retaining component 3 over the smaller last portion of its swivel movement a guide 5 is provided within component 2. This guide is formed by the inner circumference of a sleeve 6 which is a short end section of component 2. The end of component 3 directly and solely adjoining the inner circumference or the like forms the corresponding hollow piercing protuberance or flexible spike 7. The assembly 1 is located permanently totally within an outer shell 8 and only by part of its length within an inner shell 9 provided radially spaced away from and in the same axis as the shell 8 with which it is integrally configured. As a locking member the shell 9 surrounds the transitional portion between the components 2, 3 firmly seated by tight radial compression, freely protruding, but less so in the same direction as the shell 8 and shorter than the shell 8. The portions 1, 8, 9 are located in the longitudinal centerline 10 of the dispenser or its pump.

For the translation from the first position with the axis 11 into the second position or operating position component 3 is swivelled through 1800 transversely to the longitudinal centerline 10 in a curved path according to the direction 12, component 3 remaining at right angles to the movement plane 17, namely in the direction 13 stationary relative to component 2. At the end of the swivel movement the member 7 flexible dives into the companion member 5 corresponding to the direction of flow 14 or parallel to the longitudinal centerline 10 corresponding to a pushbutton. First contact of the member 7 with component 2 does not occur until after half of the swivel path, e.g. after at least 120° has been covered. The spacing 15 between the longitudinal centerline 10 and axis 11 in the first position equals the sum of the radial expansions of components 2, 3 between these axes in the region of the conection 4. As compared to this radial extent of component 2 or of component 3 the corresponding radial extent of the associated member 5 and 7 respectively is smaller. In the second position components 2, 3 directly come into pressure-tight contact with each other in a plane 16 at right angles to the longitudinal centerline 10 and axis 11 or their common axial plane 17, only the member 7 protruding beyond plane 16 in the molding position.

FIG. 4 indicates dot-dashed part of the tooling 18, 19 or injection mold or their movable pullers whereas FIG. 3 indicates dot-dashed the molding position of components 2, 3 as well as the corresponding component of the dispenser. Locking means 20 configured integrally with components 2, 3 as well as separately therefrom serve to interlock components 2, 3 in the operating position.

The member 5 forms at an inner circumference guide surface areas 21, 22 for companion surface areas 25, 26 of the member 7, they comprising a conically flared or inclined flanked inlet opening 21, at the narrowest portion of which a flared centering surface area adjoins. The member 7 first comes into contact with surface area 21 by the inclined surface area 26 provided at its end, after which its adjoining surface area 25 engages the annular groove 22. At the same time a further inclined surface area comes into centering contact with surface area 21. Surface areas 21, 22 are curved about the longitudinal centerline 10 and surface areas 25, 26 about the axis 11 which coincides with the longitudinal centerline 10 in the second position. The end or face surface area 29 of the member 7 in the shape of a ring or section thereof is located with no contact in the operating position.

The connection 4 contains a sole micro-joint 30 of solid cross-sections throughout not more than four or two tenths of a millimeter thick and less than 1 mm wide for flat or rectangular cross-sections. Both of these dimensions are substantially smaller than the diameters of surface areas 21, 22, 25, 26. The flat cross-section of the connecting member 31 is located at right angles to the longitudinal centerline 10 and axis 11 and to the plane 17. The member 31 is located symmetrical to the plane 17 and extends in every position up to the plane 16, it forming a film-type hinge including a hinging axis 23 located in the plane 16 as well as at right angles to the plane 17. The middle plane 17 of the member 31 located in the molding position parallel to and between the longitudinal centerline 10 and axis 11 and at right angles to the plane 17 lies in axis 23 and parallel to the corresponding axial plane 24 of the longitudinal centerline 10. The length of the member 31 along the plane 17 is smaller than the width thereof along the plane 17 and maximally as large as or smaller than its thickness parallel to the longitudinal centerline 10 and axis 11. The side edges 32 of the member 31 at right angles to the planes 17, 24 are parallel. The link 31 extends about the longitudinal centerline 10 and axis 11 respectively by an angle of an arc of max. 35° or 25° and min. 15° or 20°.

The member 31 forms from axis 23 to the outer circumference of the corresponding component 2 or 3 a link section 33 or 34 respectively having the same cross-sections. The section 33 adjoins the jointing surface area or outer circumference of component 2 in a section curved about the longitudinal centerline 10 up to the flanks 32. For joining the section 34 the outer circumference of component 3 curved otherwise about the axis 11 comprises a flat 37 parallel to the plane 17, 24 and symmetrical to the plane 17. The flat 37 is roughly twice as wide as the member 31 and its surface 38 facing away from plane 16 in the molding position and parallel to the plane 16 thus forms the bottom of a gap defined by the surface areas 36, 37, the width of which is smaller than each of the cited dimensions of the member 31. This gap is flanked by the outer circumference of the shell 39 of the bush 2 as well as over its full height by the surface area 37. The surface area 37 translates at an angle into an annular face or pressure surface area 40 at which the force can engage at right angles on moving in the direction 12. The surface area 40 is formed by an annular collar 41, it adjoining the face 43 facing away therefrom at the member 7. Protruding beyond the surface area 40 is the remaining, longest section of component 3 contrary to the direction 14. The protuberance 41 forms the portion of component 3 furthest protruding radially and as compared to all other longitudinal sections, the surface area 7 as well as the sole joint for the member 31. At the end protruding beyond the surface area 40 the otherwise hollow or sleeve-shaped component 3 forms a closed face wall 42.

The surface area 43 forms a flat stop 43 located in the molding position in the plane 16, it adjoining in the operating position a flat companion stop 45 of component 2 which is also located as the end or face in the plane 16 and adjoins surface area 21 annularly as well as at an obtuse angled cross-section. The surface areas 21, 22 are formed by the inner circumference of an opening 44 defined circularly about the longitudinal centerline 10 and form both a radially protruding and recessed snapper 46 for corresponding companion sections of a snapper 47 of the member 7 whose snapper surface areas 25, 26 are configured complementary to snapper surface areas 21, 22 and are able to deflect flexible radially as well as pliantly, as a result of which components 2, 3 are positively interlocked by themselves and without engagement of the member 9 in the operating position with zero clearance against turning out of place or axially or radially movements.

The members 8, 9 integrally adjoin a common face wall 48 at which they protrude only contrary to the direction 14, the middle section 49 of the assembly 1 freely protruding beyond the free end of the shell 9. Component 3 extends by its flat end surface area up to the inner surface area of the wall 48 whose outer side is penetrated by the sole opening of the medium orifice 50. This opening is formed by the end of a nozzle passage located in the longitudinal centerline 10 and penetrating only the wall 48. The narrowest section 54 of the nozzle passage adjoining the opening 50 translates upstream into a conically flared section 55, it extending up to the inner surface area of the wall 48 and up to the corresponding end surface area of component 3. Component 2 is penetrated in the longitudinal centerline 10 full length by a passage 51 which is continued in the dished component 3 up to the inner side of the face wall 42. Following the annular bottom of the opening 44 the passage 51 has cross-sections which are not circular but in the shape of a three-armed spider continuously flared at an acute angle in the direction 14. Contrary to the direction 14 this cross-section translates smoothly into further circular cross-sections constricted at an acute angle, they extending up to the corresponding end of component 2.

At the inner circumference of the collar 41 component 3 is penetrated parallel to the longitudinal centerline 10 by two opposing penetrations 53. These are curved as ring segments about the longitudinal centerline 10 or axis 11 and form with the radially inner defining surface area a smooth continuation of the outer circumference of the section protruding beyond the surface area 40. Provided in this outer circumference are longitudinal grooves 56 extending over the full length of component 3, one of which in each case forms with equal cross-sections a smooth continuation of the corresponding penetration 53. Provided in surface area 29 is a transverse groove extending up to the surface area 43 at right angles to the plane 17, the same in width as the passagways 53, 56 and which divide the protuberance into two members 47 located spaced away from each other and capable of radially flexing against each other parallel to the plane 17. At the end surface area protruding beyond the protuberance 41 component 3 comprises a guidance swirler 60 for the medium, defining it like the passages 56 in common with the wall 48. Provided in the end surface area is a central recess 58 into which two transverse and tangential passages 58 port opposite each other and branching from the passageways 56 so that the medium is caused to flow swirling and rotating about the longitudinal centerline 10 and axis 11 in being directly introduced into the section 55. The circular definition of the latter flushly adjoins the definition of the chamber 58. The grooves 59 are constricted in the direction of the chamber 58 with which they have bottom surface areas full length thereon in the same plane and adjoin the bottom of the grooves 56 with a width which is smaller than the width of the grooves 56. The penetrations 53 are solely defined by component 3.

The dispenser comprises two units or base bodies 62, 63 which for actuating dispensing need to be manually shifted against each other parallel to the longitudinal centerline 10 after a lock 61 is defeated in shortening the dispenser. Belonging to the second base body 63 integrally are the walls 8, 9, 48 and the orifice 50 forming a discharge nozzle 64 freely protruding in the direction 14 and continuously reduced in the outer width of the shell 8 for insertion into a bodily opening such as a nostril. The inner circumference of the shell 9 also tightly adjoins the outer circumference of the collar 41 and is constricted in the plane of the surface area 40 in forming a recess 65, at the bottom surface area of which the passage 54, 55 adjoins. This passage has a length of maximally two or one millimeter and as compared thereto a smaller minimum width. The opening 65 sealingly adjoins full length the outer circumference and the end surface area of component 3 where it defines the passageways 56, 53 and adjoins a shoulder surface area 66 which sealingly stops the surface area 40 in the sense of locking means 20. The section of component 3 protruding beyond the collar 41 comprises like the other protuberace 7 a smaller outer width full length than the collar 41 and forms a nozzle core 67 for the atomizer nozzle 50. The outer width of the core 67 amounts to max. 4 mm or 2.5 mm and that of component 2 as well as of the collar 41 max. 5 mm or 4 mm, resulting in a minimum capillary acting width of the passage 51 of less than one or half a millimeter.

With this minimum width the passage 51 penetrates the upstream end of component 2 forming in the longitudinal centerline 10 a needle 68 which is slimmer and shorter than the section 49 adjoining it, into which it translates by an outer shoulder, is conically tapered at an acute angle contrary to the direction 14 and is penetrated at the bevelled end by an inlet opening 69 of the passage 51. The assemblies 62, 63 form a pump 70 having no return spring or return stroke, the working stroke of which is smaller than the length of the assembly 1 by at least the half or maximally two-thirds. FIG. 1 illustrates its starting position and FIG. 3 its final position or a position shortly before its final position. This dispenser assembly smaller both in length and outer width comprises an integrally, dished medium reservoir 71 of glass or a plastics material of similar properties. The elongated reservoir 71 is inserted contrary to the direction 14 into the integrally dished base body 62 by the majority of its length over which it is thus clasped by the shell of the base body 62 at the outer circumference in a snug fit. Its flared outer collar is located outside of the body 62 permanently in the shell 8. The inner circumference of the receptacle 71 forms a cylindrical runway 72 for sealing slide guidance of an elastomeric closure or piston 73. The bottom of the reservoir 71 is supported by members 74 spaced away from the bottom of the body 62 by a distance twice as much as the working stroke. The members 74 may be a central driver as shown in in the lower portion of FIG. 1 or, longitudinal ribs jutting from the inner circumference as shown in the upper portion of FIG. 1 and configured integrally with the body 62. Before the reservoir 71 is inserted into the bodies 62, 63 the piston 73 is inserted to close off the reservoir space in a hermetic seal and may contain germicidal sterilizing means.

Spaced away in the middle between its end surface areas the sleeve-shaped, cylindrical piston 73 comprises a transverse wall or diaphragm 75, the faces of which are bottom surface areas of identical recesses 76, which up to each corresponding end surface area 77 are flared with the same conicity and the same cross-section as the remotest end of the needle 68. In the starting position the tip of the needle is located spaced away by a gap from the intermediate wall 75 maximally two or one millimeter thick. At the start of the stroke of the assembly 62 in the direction 14 the needle 68 pierces the wall 75 without releasing any particles, the ring shoulder 78 then being stopped by the end surface area 77 between the sections 49, 68. The tip of the needle is then located set back relative to the other end surface area of the piston 73 in the other recess 76 without contacting it. In this arrangement the outer circumference of the needle 68 contacts the first-mentioned recess 76 with radially pressure and is able to boost the radial pressure of the outer circumference of the piston 73 on the cylinder 72. The reservoir space can be filled with liquid medium totally with no gas inclusions. As soon as the tip of the needle has pierced the wall 75 and the piston 73 slaved in the movement contrary to the direction 14, the medium flows from the reservoir chamber in the direction 14 through the inlet opening 69 first into the gas-filled passage 51 and then into the passageways 52, 53, 56, 59, 58 of component 3 to then emerge pressurized from the passage 54, 55. At the end of the stroke the piston 73, but not component 2, is stopped by the bottom of the reservoir 71. Up to this end the outer circumferences of the reservoir collar and of the body 62 are guided by the inner longitudinal ribs 79 of the shell 8. These protuberances 79 have a triangular cross-section, they forming angular flanked line edges for low-friction guidance. In the final position the reservoir 71 may be located slightly spaced away from the shell 9 or accommodate the latter. The assembly 1 protrudes by more than half its length beyond the shell 9.

For forming the discharge actuator 80 the bodies 62, 63 feature squeeze finger rests 81, 82 facing away from each other. The outer side of the bottom of the body 62 forms the recessed finger rest 81 beyond which the body 63 protrudes in the starting position contrary to the direction 14. The end of the nozzle 64 or of the shell 8 facing away from the orifice 50 integrally adjoins a substantially widened cap 83, namely the flat face wall 84 thereof at right angles to the longitudinal centerline 10 which in turn translates at the outer circumference integrally into the cap shell 85 freely protruding contrary to the direction 14. The outer side of the wall 84 forms only at two sides of the nozzle 64 facing away from each other the finger rest 82, since the walls 84, 85 as viewed axially are elongated or oval parallel to the plane 17 and 24 respectively or to the plane 17. The long flanks of the shell 85 opposite each other are penetrated by identical scallops 86 facing each other as of the end edge of the shell 85 but only over part of the length thereof, through which the user can obtain finger contact, such as thumb contact, for actuating the finger rest 81. The bottom of the reservoir 71 is located protected spaced away from and between the wall 84 and the scallops 86 whose height is greater than the working stroke.

The lock 61 blocks in the starting position the actuator 80 positively and forms a direct pressure point connection between the bodies 62, 63, it comprising two members 87, 88 each engaging the other via a snapper connection 89, each of which is configured integrally with the corresponding body 62, 63. The flat ring-shaped member 87 directly adjoins via a break location 90 the outer circumference of the body 62 with a spacing between the ends thereof. The member 88 freely protrudes from the wall 84 contrary to the direction 14, it forming annular or circular spaced partial sections. Its inner circumference forms with the outer circumference of the member 87 the connection 89. The frangible link 90 may be dimensioned as dictated by the member 31, the parting surface areas of which after fracture are located in the outer circumference of the body 62 or displaced radially inwards relative thereto. However, the frangible locations may also be located only between the guide surface areas of the ribs 69, e.g. when the bodies 62, 63 are located in a specifically rotated position relative to each other and/or contrary to that as shown are positively prevented from turning out of place at least in the starting position or in a first subsequent partial stroke relative to each other.

The member 87 is assembled with the body 62 by being inserted in the direction 14 into the body 63 until the stopper connection 89 advances. As of a predefined force with which the finger rests 81, 82 are squeezed the frangible location 90 fractures and due to the subsequent substantially reduced resistance to actuation the working stroke starts and ends at a correspondingly high speed. The assembly 1 is likewise inserted in the direction 14 into the bodies 63, 64, it being located set back from the finger rest 82 and the corresponding ends of the ribs 79. The piston 73 too, is located in the direction 14 permanently spaced away from the wall 84 totally within the shell 8.

Referring now to FIG. 4 there is illustrated the mold for producing a base body 18 including pushers or pullers 19 movable therein parallel to the longitudinal centerline 10 and axis 11. The body 18 forms the surface area for molding the outer circumference of component 2 from the surface area 45 up to the end of the needle 68, the outer circumferences of the sections 41, 67, the surface areas 40, 56, 58, 59, the remaining end surface area of the section 67 and, where necessary, the surface areas 53, the molding surface areas of which could also be provided on the puller 19. The body 18 forms in addition the surface areas for molding the surface areas 32, 37, 38 of the member 31. The puller 19 forms the surface areas for molding the surface areas 43, 45 located in the same plane, the protuberance 7, the transverse groove thereof, the passage 51 and the recesses 44, 52. After solidification or polymerization of the plastics in the mold the puller 19 is retracted in the direction 14 until it is separated from the assembly 1, the members 46, 47 thereby flexing due to the elastomeric properties of the material. The height of the members 46, 47 is less than five, two or one-tenth of a millimeter. The assembly 1 can now be ejected in the direction 14 fully or only partly in the direction 14 from the body 18 so that component 3 is exposed whilst component 2 is still retained in the body 18. Then or after total separation of the assembly 1 from the mold, components 2, 3 are swivelled in the direction 12 up to mutual connection in the same axis. In FIG. 3 the shading of component 3 has been selected different to the shading of component 2 merely to make for a better overview. The oval end or annular surface area of the needle 68 is produced after demolding by cutting.

Referring now to FIG. 8 there is illustrated component 3 spaced away from and about the longitudinal centerline 10 and axis 11 penetrated by separate longitudinal passages 52 adjoining upstream via substantially shorter transverse passages 53 the outer circumference of the core 67 before translating into the passageways 56. The passages 52, 53 are circumferentially totally defined by component 2. The surface area 45 is arranged recessed relative to the corresponding face of component 2 by the thickness of the collar 41 as the bottom of the opening 44, it being open towards the member 41 over the width thereof as groove 21. As a strap the collar 41 protrudes beyond the circumference of the core 67 only by the width of the member 31, the collar 41 filling the groove 21 in the operating position. The groove 21 penetrates the edge of the opening 44 in the plane 17. In the molding position component 3 extends only up to the plane 16, beyond which component 2 protrudes. Groove-shaped transverse passages 53 may be provided in the surface area 43 angularly adjoining the passageways 56. The upper end of component 2 is tapered in the form of a truncated cone. The section 49 comprises spaced away from and between components 3, 68 a flared section, the one end of which is stopped by the end of the shell 9, this being the reason why the mold puller 19 comprises the molding surface areas up to and for this end as well as the circumferential surface areas of component 2 located inbetween.

It is evident from FIGS. 8 to 19 that no snapper connections are provided between components 2, 3 which are held together either solely by engaging component 64 or by bonding or welding their connecting surface areas. As evident from FIGS. 11 to 16 the direction 12 is located linear at right angles to the longitudinal centerline 10 and axis 11, it being evident from FIG. 11 that component 3 protrudes longitudinally beyond component 2. The link 31 is a designed frangible member whose flat necked parting zone 35 is located in the plane 16. The member 31 adjoins only the surface area 45 of component 2 at the surface area 36 up to the corresponding outer circumference and only the cylindrical curved outer circumference of component 3 at surface area 37 up to the surface area 43 and thus does not extend beyond the plane 16 contrary to the direction 14. In surface area 36 the parting zone 35 is located in the plane 16, the member 31 thus forming in the operating position a protuberance at the circumference of component 3. The exposed base surface area 38 of the member 31 inclined to the plane 16 may be curved concave or otherwise as shown in the axial view in FIG. 16 or adjoin surface area 45 to ensure a precisely defined fracture response. The base surface area facing away therefrom may be likewise located exposed or in the direction of the zone 35 at an acute angle to the surface area 48 and set back from the surface area 43 by a recess. The e.g. cylindrical component 3 comprises over its length circular cross-sections having flats 26 facing away from each other the same in width in a close fit with the side flanks 21 of the continuation groove of the opening 44, the bottom of which is formed by the surface area 45. Within the shell 9 these inclined surface areas 26 define the passageways 56 into which the grooves or transverse passages 53 port outside of component 2. At the side facing away from the member 31 component 3 may comprise a collar 41 as evident from FIGS. 8 to 10 which in the operating position fills out the groove 21 up to the outer circumference and up to the end surface area of component 2. Its side flanks thus adjoin the surface areas 26 in the same plane.

Figure 12:
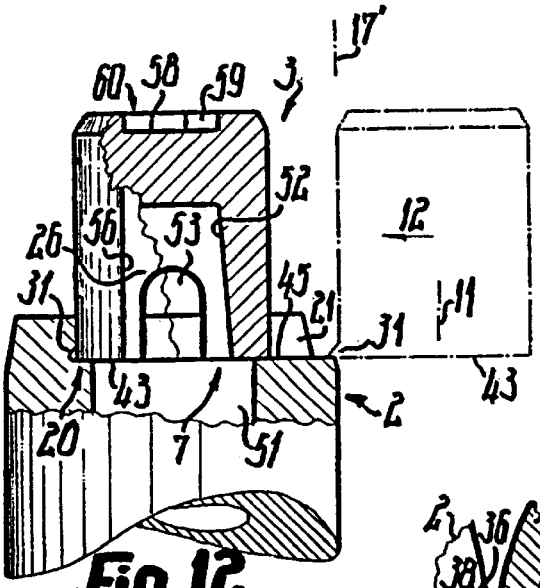
Figure 11:
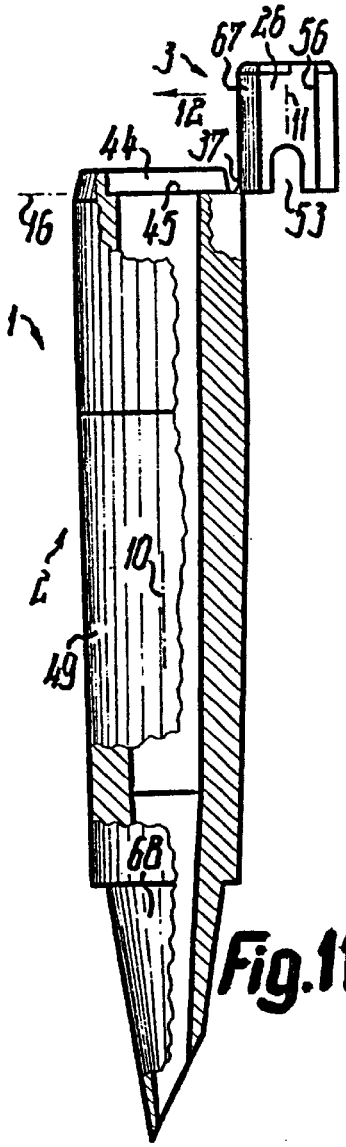
Figure 16:
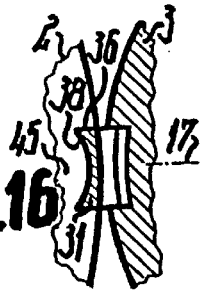
FIG. 16 is a cross-section through FIG. 15, and FIGS. 17–19 illustrate a further embodiment of that as shown in FIGS. 11 to 13.
Figure 13:
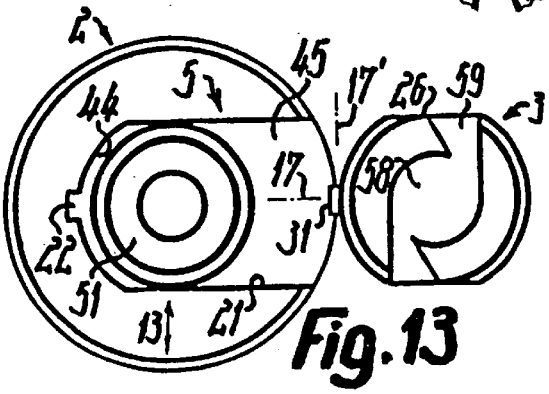
Figure 15:
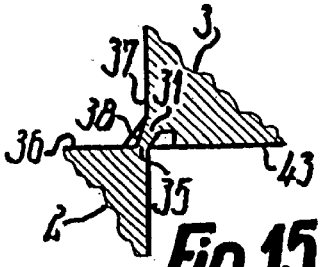
FIG. 15 is a detail taken from FIG. 11 on a magnified scale.

By pressurizing the side of its circumference facing away from the member 31 component 3 is shifted in the direction 12 contrary to the longitudinal centerline 10. On commencement of this movement the member 31 shears in the plane 16 from the surface area 45 at parting zone 35 after slight elastic or plastic deformation. In this arrangement the following edge of the recess in the surface area 43 may be a shear edge for smoothing the fractured surface area of component 2. It is not until a short shifting movement has been executed that component 3 then enters the groove 21 by which it is positively guided in the direction 13 until its leading circumference is stopped by the inner circumference of the opening 44. On this stoppage member 31 enters an opening 22 of this circumference. This opening adjoins the surface area 45 and as shown in FIG. 12 may extend as an axial latch only over part of the height of the opening 44, or as shown in FIG. 13 over the full height, it being this engagement that forms a member of the lock 20.

Figure 18:
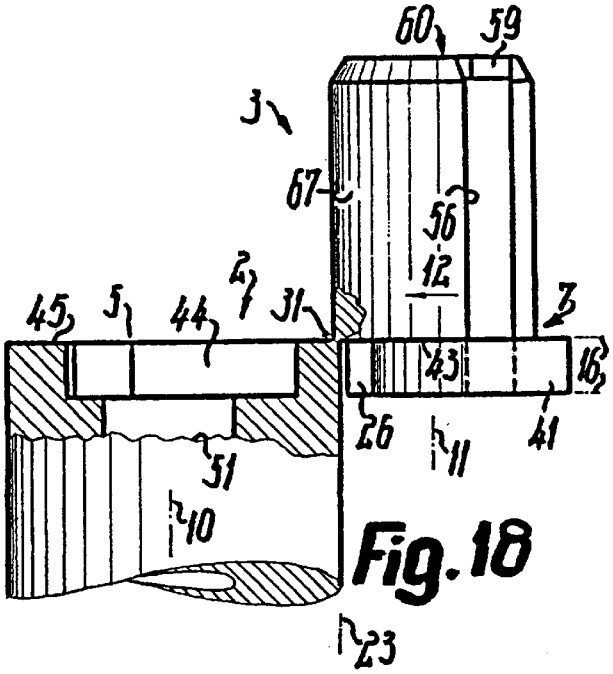
Figure 17:
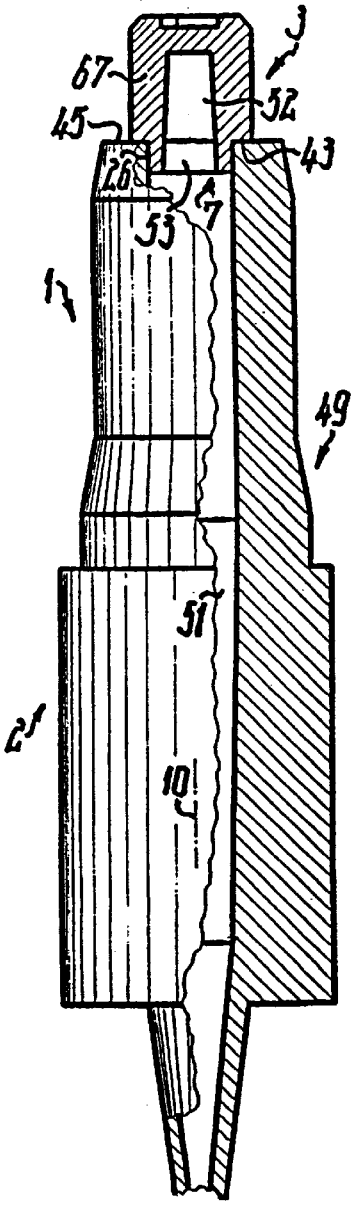
Figure 19:
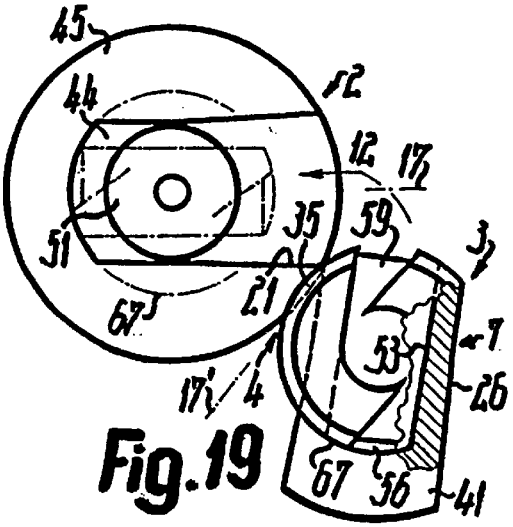

Referring now to FIGS. 17 to 19 it is evident that the movement 12 is both a swivel movement about the axis 23 and also a directly subsequent linear movement. The plane 17' is located inclined or at right angles to the plane 17. The member 31 may have a lenticular double-convex cross-section, namely defined by the outer circumferences of both components 2, 3 and located directly adjacent to a flank of the groove 21. The opposing surface areas 43, 45 overlap each other with the cross-section of the member 31 in forming the frangible zone 35. The collar 41 protrudes beyond the surface area 43 by its flanks 26, its surface area 45 being a snug fit in the recess 44 and narrower than the core 67. On commencement of rotation about the axis 23 located parallel to the longitudinal centerline 10 and axis 11 and within the outer circumferences of components 2, 3 the member 31 is sheared in torsion. In this arrangement the one flank 26 extends up to the end of the corresponding flank 21 located at the outer circumference of component 2, the other flanks 26, 21 not engaging each other until having been turned through at least 90°, as of which the linear shift occurs up to the location in the same axis. The plate or strip-shaped collar 41 then totally fills the opening 44. Components 2, 3 can then also be interlocked by an automatic or wedge-type catch. Adjacent to the flanks 26 on both sides the core 47 adjoins the end surface area of component 2 as indicated dot-dashed in FIG. 19. The surface area 66 as shown in FIG. 3 is then able to securely adjoin both surface area 45 and the surface area of the collar 41 located in the same plane as evident from FIGS. 8 to 10. The surface area of the protuberance 41 sealingly adjoining the bottom of the opening 44 is provided within the circumference of the core 67 with a transverse groove 53 angularly adjoining the passageways 56, only one of which penetrates the protuberance 41 so that it is defined thereby over the full circumference.

It is understood that all features of all embodiments may be provided in a common embodiment, namely in common with each other or added to each other. All properties and effects may be provided precisely or merely substantially or approximately as described and also in a greater departure therefrom, depending on the requirements. Any indication of reference locations at right angles is also understood to include transverse locations in a departure therefrom. The dimensional relationships as illustrated are particularly favorable.

What is claimed is:

1. A media dispenser including an assembly comprising:

at least two components defining an operating position and connected integrally to each other in a first position via a connection adjoining connecting zones of the components, said components movable from said first position against each other into at least one second position, wherein one of said components in the second position protrudes beyond the other said component, and wherein at least one of said components forms a constricted spike at an end facing away from the other said component.

2. The dispenser as set forth in claim 1, wherein at least one of said components forms an inner body, a freely protruding slave element, a snugly enclosed rod section, a plunger, a tubular passage, a piston body, a piercing tip, a coupling member for a medium expeller, and a nozzle core, and defines a swirl chamber, a longitudinal passage, and a transverse passage.

3. The dispenser according to claim 1, wherein said components comprise at least one of significantly differing volumes and lengths.

4. The dispenser according to claim 2, wherein at least one of said components is substantially tubular over most or all of its length.

5. The dispenser according to claim 1, wherein one of said components engages an insertion opening in the other said component by a protuberance, said components being directly interlocked via a snapper.

6. The dispenser according to claim 1, wherein said components are interconnected via a hinge, the hinge being a film-type hinge having a sole hinging axis substantially at right angles to a longitudinal centerline of said dispenser.

7. The dispenser according to claim 1, wherein said components are interconnected in the first position via a predetermined breaking member, and comprise in the second position fractured surface areas located transversely to a longitudinal centerline and axis of the dispenser.

8. The dispenser according to claim 7, wherein one of said components forms a sliding guide for the other said component along an end surface area thereof.

9. The dispenser according to claim 6, wherein said joint directly integrally connects outer circumferences and faces of said two components to each other.

10. The dispenser according to claim 1, wherein the dispenser is configured as a receptacle and discharger for active substances selected from the group consisting of physiologically active substances, hormones, peptides and protein cleavage products.

11. The dispenser according to claim 1, wherein each of said components protrude away from each other by most of its length, said components being located substantially in the same axis in said second position.

12. The dispenser according to claim 2, wherein said components comprise at least one of significantly differing volumes and lengths, each of said components protruding beyond the other by most of its length and said components being located substantially In the same axis in the second position.

13. The dispenser according to claim 1, wherein the first said component protrudes beyond the other said component along a longitudinal centerline of the dispenser.

14. The dispenser according to claim 1, wherein said components are interconnected via a predetermined breaking member.

15. A media dispenser including an assembly comprising:

at least two components defining an operating position and connected integrally to each other in a first position via a connection adjoining connecting zones of the components, said components movable from said first position against each other into at least one second position, wherein one of said components in the second position protrudes beyond the other said component, and wherein a rotary lock is provided between said components which extends only over part of the length of at least one of said components.

16. The dispenser according to claim 15, herein said rotary lock is provided at the outer circumference of at least one of said components.

17. A media dispenser including an assembly comprising:

at least two components defining an operating position and connected integrally to each other in a first position via a connection adjoining connecting zones of the components, said components movable from said first position against each other into at least one second position, wherein one of said components In the second position protrudes beyond the other said component, and wherein the dispenser comprises a first base body with means for mounting a media reservoir and a second base body including a media orifice movable together with said assembly opposite said first base body for discharge actuation.

18. The dispenser according to claim 17, wherein said assembly forms a plunger for a piston mounted in said first base body, both of said components being enclosed and firmly seated by said second base body.

19. The dispenser according to claim 17, wherein said assembly extends at one end up to a wall of said second base body and integrally defines said media orifice as well as forming with the other end a narrow protuberance for opening a closure of said media reservoir provided in said piston.

* * * * *